United States Patent [19]

Gilling

[11] 4,166,535

[45] Sep. 4, 1979

[54] PACKAGE STRUCTURE

[75] Inventor: Donald A. Gilling, Neenah, Wis.

[73] Assignee: American Can Company, Greenwich, Conn.

[21] Appl. No.: 904,410

[22] Filed: May 10, 1978

[51] Int. Cl.[2] ..... B65D 83/00

[52] U.S. Cl. ..... 206/470; 206/625

[58] Field of Search ..... 206/470, 467, 469, 461, 206/462, 625

[56] References Cited

U.S. PATENT DOCUMENTS

| | | | |
|---|---|---|---|
| 2,249,052 | 7/1941 | Seiffert | 206/625 |
| 3,174,621 | 3/1965 | Watson | 206/470 |
| 3,502,486 | 3/1970 | Lundquist | 206/461 |

*Primary Examiner*—William T. Dixson, Jr.

*Attorney, Agent, or Firm*—Robert P. Auber; Ira S. Dorman; George P. Ziehmer

[57] ABSTRACT

A reclosable blister card package comprises a plastic blister having a flanged portion and a raised product holding portion. A paperboard card is releasably affixed to the flanged portion, and a portion of the card is folded over to present a folded edge extending over and engaging the flanged portion of the blister. A pair of parallel creases are provided in the paperboard card, one of which creases is disposed in substantial registry with the folded edge. Construction and arrangement is such that pivotation of the folded portion about the one crease away from the blister is effective to release the overlapped flanged portion from the folded edge and accommodate subsequent release of the card from the blister by pivotation of the card therefrom about the other crease.

4 Claims, 4 Drawing Figures

PACKAGE STRUCTURE

BACKGROUND OF THE INVENTION

This invention relates to package structure, and more particularly to improvements in blister card packages of the reclosable type.

While reclosable blister card packages have attained wide acceptance, difficulties have been encountered in providing both economical and effective locking means for maintaining reclosure of a package of this type once it has been opened. Known locking means heretofore have required provision of specially shaped tabs, slots, as well as built up cards to serve as the operating lock elements.

The following is a listing of U.S. Patents believed material to the examination of this application, together with a concise explanation of the relevance of each:

U.S. Pat. No. 3,127,010 discloses a blister 20 including flanges 28 adherent to a card 10, and pivotally releasable therefrom along fold lines 12 and 14. Slits 16 and 18 in card 10 receive corners of flanges 28 to relock the blister to the card.

3,174,621 discloses a blister 14 bonded to a card portion 20 by adhesive dots 26 that are releasable to accommodate pivotation of portion 20 in provision of access to contents of the blister. Relocking is afforded by pivoting locking tongue over flange 16 of blister 14.

3,792,181 discloses a folded locking flange 92 (FIGS. 9, 10) on a blister to accommodate pivotal opening of a cover having a flange 94 retained by flange 92.

It is a general objective of the invention to provide improved blister card package structure of the pivotally opening type affording both economy and effectiveness of relocking construction.

SUMMARY OF THE INVENTION

In achievement of the foregoing as well as other objectives and advantages, the invention contemplates a reclosable blister package, comprising: a blister having a flanged portion and a raised product holding portion; a paperboard card releasably affixed along a portion of its periphery to said flanged portion; a portion of said card folded over to present a folded edge extending over and engaging said flanged portion of said blister; and means defining a pair of creases in said card disposed in spaced, substantially parallel relationship to one another, one crease of said pair being disposed in substantial registry with said folded edge, the construction and arrangement being such that pivotation of said folded portion about said one crease away from said blister is effective to release said overlapped flanged portion from said folded edge and accommodate subsequent release of said card from said blister by pivotation of said card therefrom about the other of said creases.

The manner in which the foregoing as well as other objectives and advantages of the invention may best be achieved will be more fully understood from a consideration of the following description, taken in light of the accompanying drawing.

DESCRIPTION OF THE PREFERRED EMBODIMENT

Figure 1:
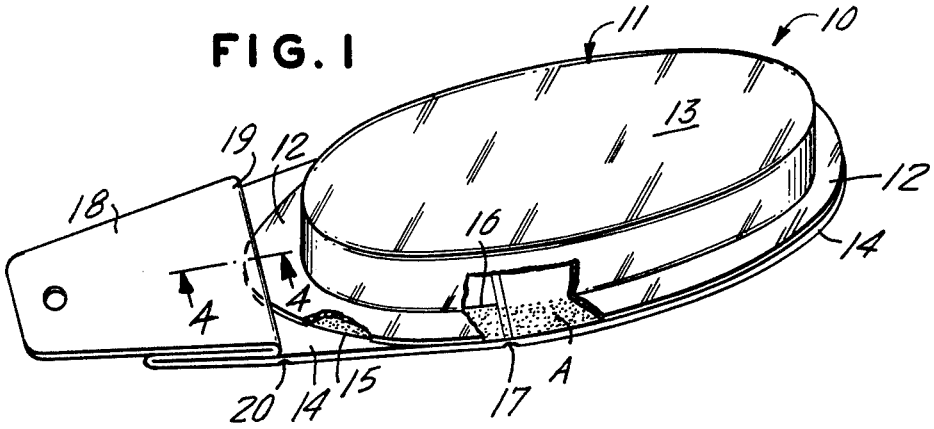
FIG. 1 is a perspective view of a blister card package embodying the invention, and with portions fragmented for convenience of illustration.

With more detailed reference to the drawing, and first to FIG. 1, a reclosable blister package 10 includes a plastic blister 11 having a peripheral flanged portion 12 and a raised product holding portion 13. A paperboard card 14 is affixed along its periphery to flanged portion 12 of blister 11 by a suitable adhesive designated generally by the letter A.

Figure 4:
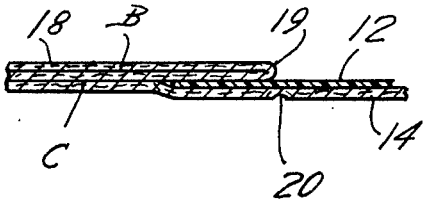
FIG. 4 is a sectional view taken in the plane of line 4—4 in FIG. 1, as seen looking in the direction of arrows applied thereto.

Releasable affixation of card 14 to a generally U-shaped section of flanged portion 12 is afforded by a pair of cut scores 15, 16 substantially coincident with edges of the U-shaped section of flanged portion 12 and terminating at opposite ends of the U substantially in the region of a crease 17, such as, for example, a score line, in card 14 extending transversely thereof. As is seen also in FIG. 4, a portion 18 of card 14 is reversely folded to present a folded edge 19 extending over and engaging the curved loop of the U-shaped section of the flanged portion 12 of blister 11. Folded portion 18 advantageously serves also as means for hanging or otherwise handling package 10. Reverse folding is maintained by adhesive provided in regions designated generally by letters B and C. Another crease or score line 20 is provided on card 14, in substantial registry with folded edge 19 and in spaced, substantially parallel relationship as respects crease 17.

Figure 2:
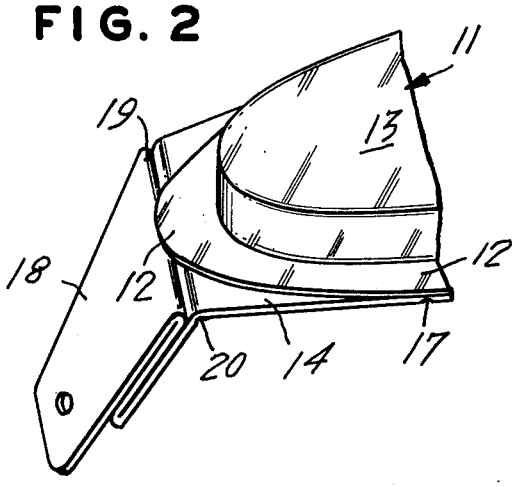
FIGS. 2 and 3 are enlarged fragmentary views of the package seen in FIG. 1, illustrating sequential steps in opening the package.
Figure 3:
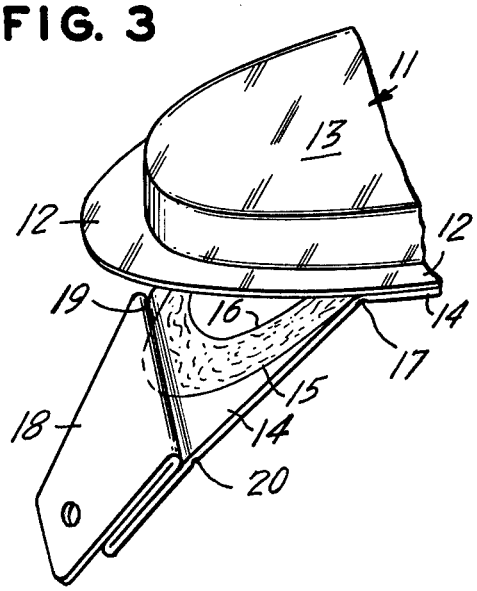

Construction and arrangement of the package is such that downward pivotation of folded portion 18 about crease 20, away from blister 11, as is seen in FIG. 2, is effective to release overlapped flanged portion 12 from engagement by folded edge 19. As is seen in FIG. 3, continued force on the folded portion 18, to pull it away from blister 11, progressively effects delamination, or ply separation, of that portion of card 14 disposed between cut scores 15, 16 and adherent to flanged portion 12, as folded portion 18 and the portion of card 14 to which it is attached pivot about 17. Contents of the package are thus exposed for use. Locked reclosure is achieved by pivoting the delaminated portion of the board toward the flanged portion 12 while flexing a portion thereof to slip it under folded edge 19 as the latter is pivoted to its original, closed position.

It will be appreciated that the invention affords improved reclosable blister card package structure affording both economy and effectiveness of locking reclosure construction.

While the description and drawing are illustrative of a preferred embodiment of the invention, it will be appreciated that changes may be made without departing from the scope of the appended claims.

I claim:

1. Reclosable blister package structure comprising: a blister having a flanged portion and a raised product holding portion therewithin; a backing member releasably affixed along at least a portion of the periphery of said flanged portion and extending across said product holding portion of said blister, said backing member having a portion thereof folded over to present an edge extending over and engaging a section of said flanged portion of said blister, the construction and arrangement being such that pivotation of said folded portion away from said blister is effective to release said overlapped section of said flange portion from said edge, to thereby accommodate subsequent release of said backing member from said blister, and whereby said package may be reclosed and latched by engaging said flanged portion under said folded portion.

2. Package structure according to claim 1 and characterized in that the recited folded portion comprises a reversely folded backing member section having a first folded portion presented toward said blister and a second folded portion presented away from said blister, the edge of said second fold comprising said edge extending over said flanged portion; and means adhering said first and second folded portions to one another and a selected area of said first folded portion to said backing member.

3. Package structure according to claims 1 or 2 wherein said backing member is a paperboard card and has a hinge crease substantially propinquant said section of said flanged portion.

4. Package structure according to claim 3, said paperboard card having a terminating crease spaced from and substantially parallel to said hinge crease, said flanged portion and said card being affixed to one another in a delaminatable region of said card defined by a pair of spaced cut score lines each coextensive with an edge of said flanged portion, said spaced cut score lines terminating at said terminating crease.

* * * * *